US007019726B2

(12) United States Patent
Yokoyama

(10) Patent No.: US 7,019,726 B2
(45) Date of Patent: Mar. 28, 2006

(54) POWER CONSUMPTION OF DISPLAY APPARATUS DURING STILL IMAGE DISPLAY MODE

(75) Inventor: Ryoichi Yokoyama, Ohgaki (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 09/747,194

(22) Filed: Dec. 22, 2000

(65) Prior Publication Data

US 2001/0005193 A1 Jun. 28, 2001

(30) Foreign Application Priority Data

Dec. 24, 1999 (JP) ..... 11-367122
Sep. 18, 2000 (JP) ..... 2000-282168

(51) Int. Cl.
*G09G 3/36* (2006.01)

(52) U.S. Cl. ..... 345/98; 345/87; 345/88; 345/89; 345/90; 345/92; 345/204

(58) Field of Classification Search ..... 345/30, 345/55, 87–99, 100, 103, 104, 204–207, 345/211; 349/1.19, 33, 34, 36, 41–47, 143; 348/674
See application file for complete search history.

(56) References Cited

U.S. PATENT DOCUMENTS 5,517,543 A * 5/1996 Schleupen et al. ..... 377/79
5,642,117 A * 6/1997 Luder et al. ..... 341/152

(Continued)

FOREIGN PATENT DOCUMENTS

EP 797182 9/1997

(Continued)

*Primary Examiner*—Vijay Shankar
*Assistant Examiner*—Leonid Shapiro
(74) *Attorney, Agent, or Firm*—Hogan & Hartson LLP

(57) ABSTRACT

A plurality of gate lines connected to a gate driver for supplying gate signals and a plurality of drain lines connected to a drain driver for supplying drain signals are provided on a substrate. Pixels are formed in the regions surrounded by these lines. Each of the pixels includes a TFT, a storing circuit connected to the source of the FTF for storing a digital signal, and a signal selector for selecting a signal A or signal B in response to the signal stored in the storing circuit and supplying the selected signal to a display electrode. Once a digital signal corresponding to a display image is written to the storing circuit of each pixel, an image can be continuously displayed, even when operation of the drivers is stopped from the next frame, by continuing the operation of the storing circuit. Because the driver operation or the like can be suspended, overall power consumption can be reduced.

24 Claims, 11 Drawing Sheets

U.S. PATENT DOCUMENTS

| | | | | | |
|---|---|---|---|---|---|
| 5,712,652 | A | * | 1/1998 | Sato et al. | 345/204 |
| 5,771,031 | A | * | 6/1998 | Kinoshita et al. | 345/100 |
| 5,790,090 | A | | 8/1998 | Libsch et al. | |
| 5,945,972 | A | * | 8/1999 | Okumura et al. | 345/100 |
| 5,952,991 | A | | 9/1999 | Akiyama | |
| 5,977,940 | A | * | 11/1999 | Akiyama et al. | 345/94 |
| 6,023,308 | A | | 2/2000 | Takemura | |
| 6,072,454 | A | | 6/2000 | Nakai et al. | |
| 6,333,737 | B1 | * | 12/2001 | Nakajima | 345/205 |

FOREIGN PATENT DOCUMENTS

| | | | |
|---|---|---|---|
| EP | 1 020 840 | | 7/2000 |
| JP | 58-23091 | | 2/1983 |
| JP | 05-8023091 | * | 10/1983 |
| JP | 60-064395 | | 4/1985 |
| JP | EP414478 | * | 8/1990 |
| JP | EP586155 | * | 3/1994 |
| JP | 8-194205 | | 7/1996 |
| JP | 08/194205 | | 7/1996 |
| JP | 09-236823 | | 9/1997 |

* cited by examiner

POWER CONSUMPTION OF DISPLAY APPARATUS DURING STILL IMAGE DISPLAY MODE

BACKGROUND OF THE INVENTION

1. Field of the Invention

The present invention relates to a display apparatus with a thin film transistor (abbreviated as "TFT" hereinafter).

2. Description of the Related Art

Recently, there have been a great demand for a portable display apparatuses such as, for example, portable television sets and portable phones, and, consequently, there is great demand to reduce the size, weight, and power consumption in these portable display apparatuses. Considerable effort has been devoted to satisfying this demand.

FIG. 1 is an equivalent circuit diagram of a conventional liquid crystal display apparatus.

As shown in FIG. 1, a liquid crystal display panel 100 includes a plurality of gate lines 51 connected to a gate driver 50 for supplying gate signals, a plurality of drain lines 61 to which data signals on data lines 62 are supplied when sampling transistors SPt1, SPt2, . . . SPtn are switched on in response to respective sampling pulses SP1, SP2, . . . , SPn output from a drain driver 60 for supplying drain signals, and an insulating substrate 10 on which the gate and drain lines are formed. A TFT 70 which is connected to a gate line and a drain line, and a pixel electrode 80 which is connected to the TFT 70 are provided near each of the cross sections between the gate lines 51 and the drain lines 61.

An external circuit board 90 is provided separately from the insulating substrate 10, and an LSI 91 for driving the panel is provided on the external circuit board 90.

Start signals for driving the panel are input to the gate driver 50 and the drain driver 60 from the LSI 91 on the external circuit board 90. Image signals are input on the data line 62.

A sampling transistor SPt is switched on in response to the sampling signal based on the start signal, and the data signal on the data line 62 is supplied to a drain line 61. Also, a gate signal is input from the gate line 51 to a gate electrode 13, and the TFT 70 is switched on. A drain signal is then simultaneously applied to the display electrode 80 via the TFT 70 and to a storage capacitor 85 for maintaining the voltage applied to the display electrode 80 for a duration of one field via the TFT 70. An electrode 86 of the storage capacitor 85 is connected to the source 11*s* of the TFT 70 and the other electrode of the storage capacitor 85, an electrode 87, is connected to a common voltage at each of the display pixels 200.

When the gate of the TFT 70 is opened and a drain signal is applied to the liquid crystal 21, the voltage of the signal must be maintained for the duration of one field. However, liquid crystal alone cannot hold the voltage, and the voltage declines as time passes. This reduction in voltage results in a flicker or an uneven display, causing a display degradation. The storage capacitor 85 maintains the voltage for the duration of one field.

When a voltage applied to the display electrode 80 is applied to the liquid crystal 21, the liquid crystal 21 aligns in response to the voltage and an image can be displayed. In this manner, a display can be obtained for both animated images and still images. In this case, voltages are applied to each of the LSI 91 on the external circuit board 90 and drivers 50 and 60 for driving each of the components. Power consumption therefore corresponds to these applied voltages.

Display of a still image on the display region comprising display pixels 200 of the liquid crystal display panel 100 as described above may be desired. For example, when the liquid crystal display panel 100 is to be used as a display section of a portable phone, on a portion of the display section a picture of a battery cell may be displayed as a still image indicating the amount of battery power remaining for the phone,.

When a conventional liquid crystal display panel is used, because the panel is driven regardless as to whether the displayed image is animated or still, the display on the liquid crystal display panel 100 is produced by driving the gate driver 50, drain driver 60, and external LSI 91 for driving the panel, even when displaying a still image.

Because of this, each of the drivers 50 and 60 and external LSI 91 constantly be consuming power, resulting in an overall increase in the power consumption of the liquid crystal display apparatus and reduction in the duration of usage time for cases of a portable phone having the liquid crystal display panel 100 with a limited amount of power supply such as a battery or the like.

In other words, the conventional apparatuses suffer from a disadvantage in that the same amount of power is constantly consumed when displaying a still image as when displaying an animated image.

A liquid crystal display apparatus with a static type memory at each display pixel is disclosed in Japanese Patent Laid-Open Publication No. Hei 8-194205 (JPA H08-194205, hereinafter referred to as the '205 publication). This liquid crystal display apparatus employs a memory in which a two-step inverter is positively feedbacked, that is, a static type memory, as a storing circuit for storing digital image signals in order to reduce the power consumption.

In this apparatus, as shown in, for example, FIG. 2 of the '205 publication, a static type memory element stores digital data and switching elements (transistors) are provided for each static type memory element. One of the terminals of the switching element is connected to a pixel electrode and a reference voltage Vref is supplied to the other terminal. The switching element receives the data stored in the memory element at its gate electrode to control the resistance value between the pixel electrode and the reference line which supplies Vref, and adjusts the bias condition of the liquid crystal layer.

However, with this configuration, when the switching element changes from the ON condition to the OFF condition, there is a possibility that the voltage of the pixel electrode becomes a fixed voltage and a direct current is applied to the liquid crystal layer. Because of this, there a refreshing operation must be performed at each of the transitions from ON condition to the OFF condition.

Even when the switching element is to be maintained in the OFF condition, when a leak current flows to the switching element, the voltage of the pixel electrode slowly approaches the reference voltage Vref due to the leak current, and uneven display may be generated due to the voltage change. In particular, for a still image, especially in cases, for example, where the remaining amount of battery is displayed on a portable phone, the period between consecutive write operation of the display data is quite long, and therefore, the amount of leak current becomes large. Thus, the uneven display becomes even a greater problem.

The conventional liquid crystal display apparatuses are suited for displaying a full color animated image corresponding to an analog image signal. Liquid crystal display apparatuses with a static type memory for storing digital image signals are, on the other hand, suited for reducing power consumption while displaying a still image with a low number of gradations.

However, because these liquid crystal display apparatuses have different image signal sources, simultaneous display of both full color animated images and a still image corresponding to the low power consumption on a single display apparatus is not possible.

SUMMARY OF THE INVENTION

The present invention was conceived to solve the above disadvantages, and one object of the present invention is the reduction of overall power consumption of a display apparatus by reducing power consumption when a still image is displayed while maintaining still image display without display unevenness. Another object of the present invention is to provide a display apparatus in which two types of displays are possible in a single display apparatus (for example, a sheet of liquid crystal display panel), one being a full color animated image display and the other being gradation display with low power consumption.

In order to achieve at least one of the objects, the present invention may be configured as a display apparatus comprising a plurality of gate lines provided in one direction of a substrate, a plurality of drain lines provided in a direction intersecting with the gate lines, and a plurality of display pixels, each of which is selected by a scan signal supplied from a corresponding gate line among the plurality of gate lines and which is supplied with an image signal from a corresponding drain line among the plurality of drain lines, wherein, each of the plurality of display pixels comprises a display element, a storing circuit for storing a digital image signal from the corresponding one of the plurality of drain lines in response to a scan signal from the corresponding one of the gate lines, and a signal selector for selecting a signal for display based on the digital signal stored at the storing circuit and for supplying the selected signal to the display element.

In the present invention, said storing circuit stores not only one digital image signal but a plurality of digital image signals, in other words, the storing circuit stores one or more bits digital signal.

According to another aspect of the present invention, in a display apparatus as described above, the storing circuit comprises a predetermined number of storing elements, the number corresponding to the number of bits in the digital image signal, and the signal selector selects a signal to be supplied to the display element from among a predetermined number of signals, the number corresponding to the number of bits in the digital image signal.

According to another aspect of the present invention, in the display apparatus as described above, the storing circuit stores the digital image signal using one or more inverters.

According to another aspect of the present invention, in the display apparatus as described above, the storing circuit stores the digital image signal using one or more inverters and a capacitor.

According to another aspect of the present invention, in the display apparatus as described above, the plurality of display pixels is capable of displaying a still image.

According to another aspect of the present invention, in the display apparatus as described above, after a still image is written to each of the plurality of display pixels as a digital image signal, the operation of a driving circuit for driving the plurality of display pixels is stopped until a point when a new digital image signal is to be written to the same display pixels.

As described above, according to the display apparatus of the present invention, a digital image signal is stored in a storing circuit, and a signal selector selects a signal corresponding to the digital data such as, for example, a predetermined direct current voltage signal and an alternate current voltage signal, and supplies the selected signal to the display element. When the display element is a liquid crystal display element as described above, the display element has a display electrode for driving the liquid crystal, and therefore, a signal can be supplied from the signal selector to the display electrode. With such a configuration, because data is stored in the storing circuit, there is no need to select the display pixel when it is desired to display a still image, until the the display content is changed. Thus, the drivers and the LSI for driving the panel do not need to be driven during that period, and the overall power consumption of the display apparatus can be reduced.

According to another aspect of the present invention, in the display apparatus as described above, the display apparatus is a liquid crystal display apparatus, and the display element includes a liquid crystal capacitor and a pair of electrodes for driving the liquid crystal capacitor.

According to another aspect of the present invention, in the display apparatus as described above, the pair of electrodes for driving the liquid crystal capacitor comprise an individual display electrode for each display pixel and a counter electrode provided to face the display electrode, and at least one of the signals selected by the signal selector is an alternating current voltage signal which oscillates around the voltage of the counter electrode.

In such a liquid crystal display apparatus, the liquid crystal must be driven with an alternating current in order to prevent image persistence of the liquid crystal. In the present invention, the signal for display which is selected by the signal selector for, for example, a one-bit image signal, is either a signal having the same voltage as the facing electrode which faces the display electrode (to control the turning off of the liquid crystal) or an alternating current voltage signal which oscillates around the voltage of the facing electrode (to control the turning on of the liquid crystal). By selecting a signal among these signals, the liquid crystal can be switched on by merely applying an alternating current voltage signal to the display electrode without inverting the voltage of the facing electrode. In other words, by applying such an alternating current voltage signal, even when the drivers and LSI are stopped for a period of time, the liquid crystal can be driven by the alternating current and the display can be maintained during that period.

According to another aspect of the present invention, there is provided a display apparatus comprising a plurality of gate lines provided in one direction of a substrate, a plurality of drain lines provided in a direction of the substrate intersecting with the gate lines, and a plurality of display pixels selected according to a scan signal supplied from corresponding one of the plurality of gate lines and which is supplied with an image signal from corresponding one of the plurality of drain lines, wherein each of the plurality of the display pixels comprises a display element, a first display circuit having a storing circuit for storing a digital image signal from the corresponding one of the drain lines in response to a scan signal from the corresponding one of the gate lines and a signal selector for selecting a signal for display based on the digital signal stored in the storing circuit and supplying the selected signal to the display element, and a second display circuit having a storage capacitor for storing an analog image signal from the corresponding one of the drain lines in response to the scan signal from the corresponding one of the gate lines, wherein the signal stored in the storage capacitor is supplied to the display element.

According to another aspect of the present invention, the first display circuit is constructed from just a storing circuit.

According to another aspect of the present invention, in the display pixel is provided a display apparatus as described above, the display pixel further comprises a display circuit selector for selectively supplying image signal from the corresponding one of the drain lines to the first or second display circuit.

According to another aspect of the present invention, in the display apparatus as described above, the corresponding one of the drain lines is constructed from a line for digital image signals and a line for analog image signals, and the first display circuit is connected to the line for digital image signals, and the second display circuit is connected to the line for analog image signals.

According to another aspect of the present invention, in the display apparatus as described above, the display pixel further comprises a data selector for selectively supplying an output signal from the first or second display circuit to the display element.

As described above, by providing for each display pixel a first display circuit for processing the digital image signals and a second display circuit for processing the analog image signals and switching supply of the image signal to these circuits according to the type of the image signal to be supplied, and/or selecting an output data from among the output data from the two display circuits, both digital and analog image signals can be processed for display by a single display apparatus having a simple switching configuration.

Moreover, when it is desired to display a still image, because the image data can be stored in the storing circuit by supplying the signal as a digital image signal, the operations of the drivers and driving LSI can be stopped when displaying a still image, and, thus, power consumption can be reduced.

Furthermore, when the present invention is embodied as a liquid crystal display apparatus, when display of an analog image signal is desired, the liquid crystal can be driven with an alternating current by inverting the level of the analog image signal in a predetermined period and supplying the signal to each of the display pixels, as is normally done.

When display of a digital image signal is desired and the liquid crystal is to be switched on, with the present invention, by selecting an alternating current voltage signal by way of a signal selector and supplying the selected signal to the display electrode of the liquid crystal display element, the power consumption can be reduced and, at the same time, a still image can be displayed while driving the liquid crystal by an alternating current.

DESCRIPTION OF THE PREFERRED EMBODIMENTS

Figure 1:
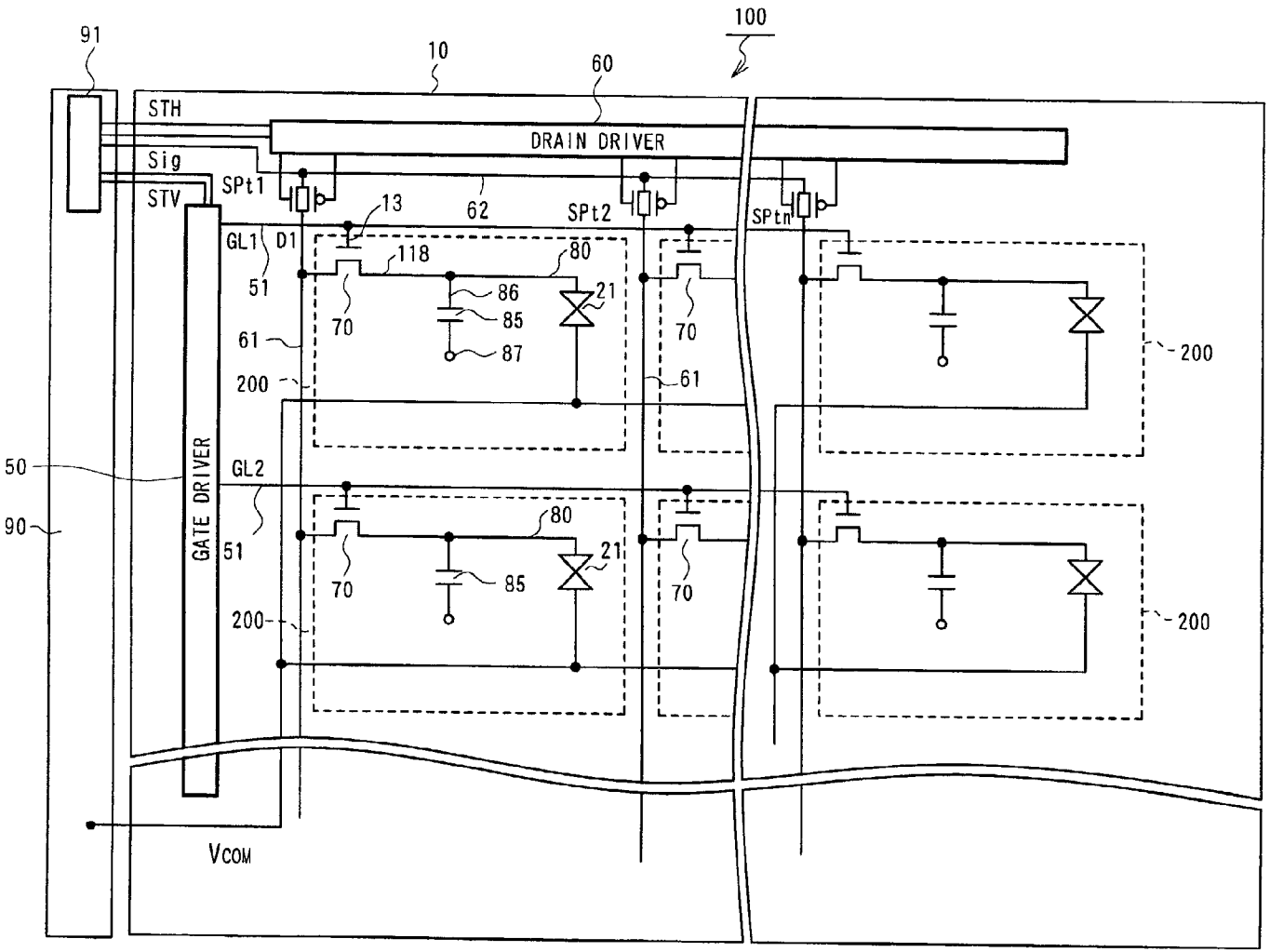
Fig.1 PRIOR ART
FIG. 1 is an equivalent circuit diagram of a conventional liquid crystal display apparatus.

Preferred embodiments of the present invention (hereinafter referred to as embodiments) embodied as a display apparatus will now be described while referring to the drawings.

Figure 2A:
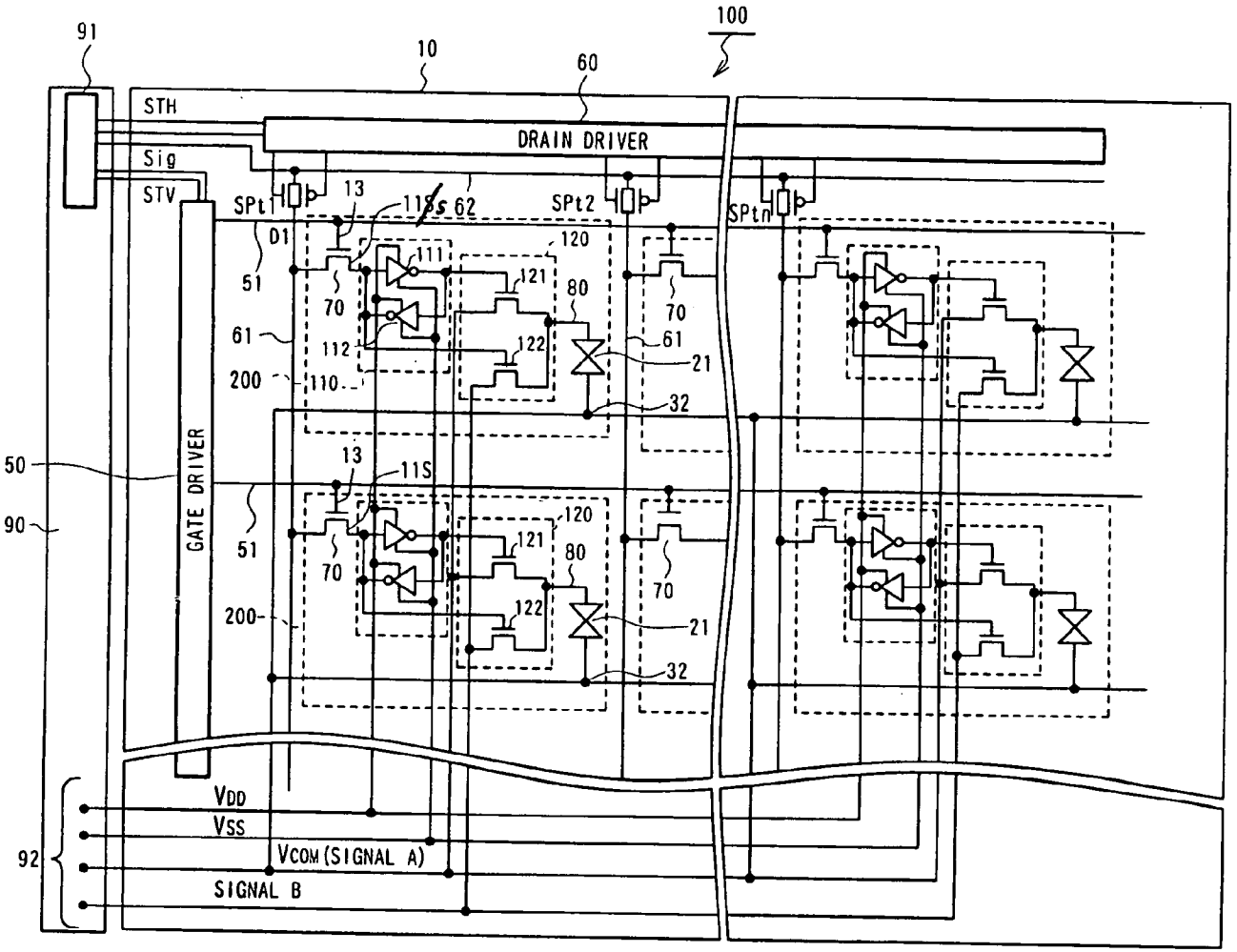
FIG. 2A is an equivalent circuit diagram of a liquid crystal display apparatus according to a first embodiment of the present invention.
Figure 2B:
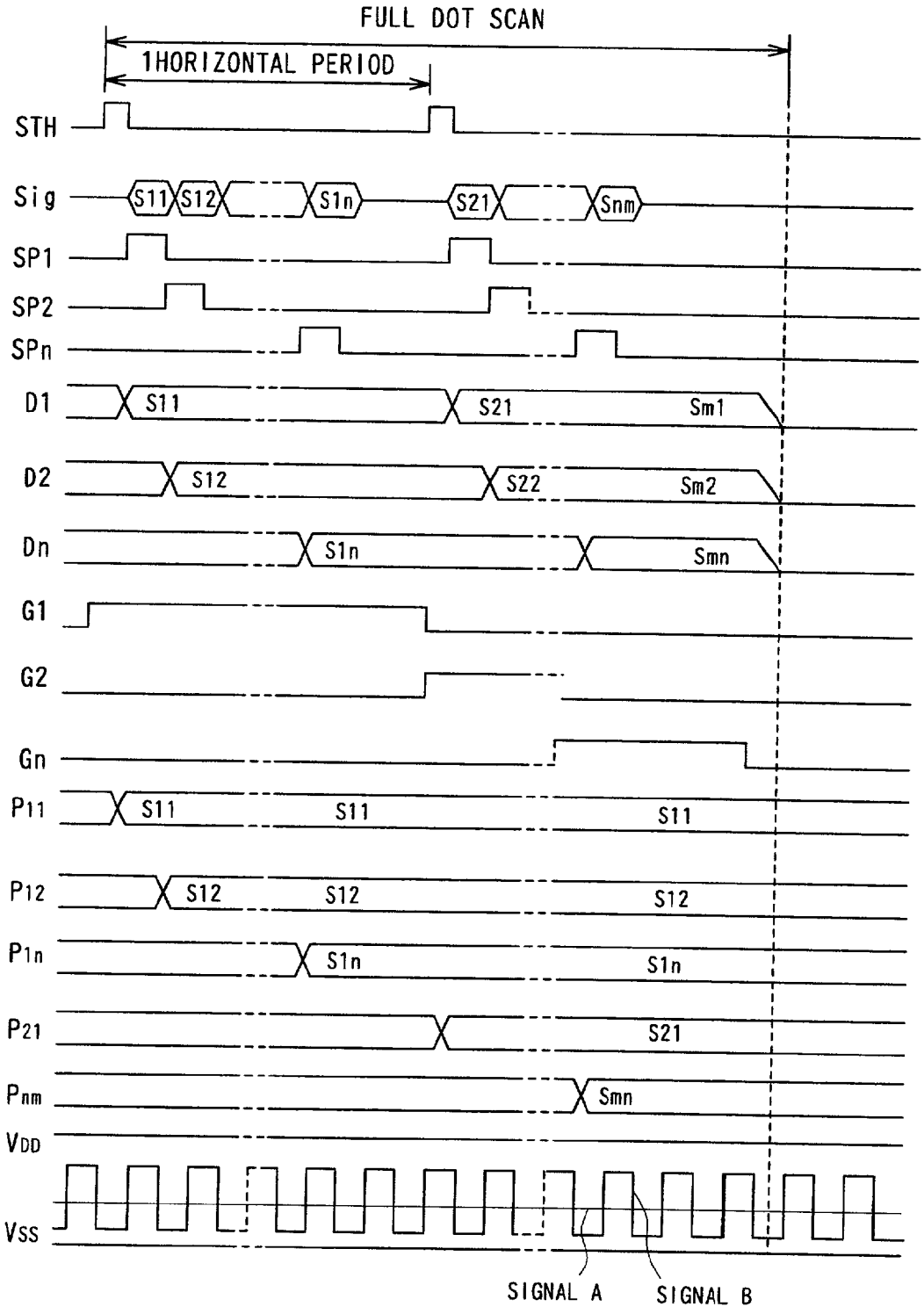
FIG. 2B is a timing chart for the liquid crystal display apparatus of the present invention.

FIG. 2A shows an equivalent circuit of a liquid crystal display apparatus where the display apparatus of the present invention is applied to a liquid crystal display apparatus. FIG. 2B is a timing chart when the liquid crystal display apparatus of FIG. 2A is driven. As shown in FIG. 2A, a liquid crystal display panel 100 is driven based on signals supplied from an LSI 91 and terminals 92 of a separately provided external circuit board 90.

On the liquid crystal display panel 100, a plurality of gate lines 51 which are connected to a gate driver (V driver) 50 for supplying gate signals are provided in the row direction (horizontal direction), and a plurality of drain lines 61, each of which is supplied with a drain signal (display data signal) controlled by a drain driver 60 and a sampling transistor SPt, are provided in the column direction (vertical direction).

Also, on the panel 100, a plurality of display pixels 200 are provided in a matrix form, each of the display pixels 200 provided in a region defined by gate lines 51 and drain lines 61. In a reflection type LCD, there are cases where the display electrodes are provided on the lines or covering the lines.

Each of the display pixels includes a TFT 70 formed near the cross section between the gate 51 and drain 61 lines and a display electrode 80 for driving a liquid crystal in each of the pixels based on the voltage of the data signal supplied via the TFT 70. In the present invention, a signal storing circuit 110 and a signal selecting circuit (signal selector) 120 are also provided between the TFT 70 and the display electrode 80.

The signal storing circuit 110 comprises two inverters 111 and 112 which are connected in reverse directions and in parallel. In other words, the inverter 111 is connected in the forward direction with respect to the source 11*s* of the TFT 70 and the inverter 112 is connected in the forward direction between the output of the inverter 111 and the source 11*s* of the TFT 70. An upper power source VDD and a lower power source VSS are connected to both inverters 111 and 112.

The signal selector 120 provided between the storing circuit 110 and the display electrode 80 selects a signal to be output to the display electrode 80 based on the signal supplied from the storing circuit 110. The signal selector 120 comprises two transistors 121 and 122, the gate of each of which is gate connected to one output of the storing circuit 110. The gate of the transistor 121 is connected to the output of the inverter 111 of the storing circuit 110 and the gate of the transistor 122 is connected to the output of the inverter 112 of the storing circuit 110. The signals selected by the two transistors 121 and 122 are either a facing electrode signal VCOM (signal A) which is a direct current voltage having the same voltage as the facing electrode, or an alternating current driving signal (signal B) which is an alternating current oscillating around the voltage VCOM for driving the liquid crystal. When the transistor 121 is switched on, a direct current signal (signal A) is selected and applied to the display electrode 80 and when the transistor 122 is switched on, an alternating current signal (signal B) is selected and applied to the display electrode 80.

As described above, the external circuit board 90 includes an LSI 91 for driving the panel and terminals 92. The LSI 91 produces timing signals (STV and STH) for operating the drivers 50 and 60 and display data signals (Sig). The terminals 92 supplies the facing electrode voltage VCOM, power supply for the drivers, power supply for the storing circuits, VDD and VSS, and the alternating current signal B, etc., to the panel 100.

The driving method of the display apparatus according to the present invention will now be described while referring to FIGS. 2A and 2B.

A start signal STV which marks the beginning of one frame is output from the LSI 91 for driving the panel of the external circuit board 90 to the gate driver 50. A start signal STH is input to the drain driver 60 every horizontal period. The drain driver 60 sequentially generates sampling signals from SP1 to SPn based on the signal STH and a clock with a cycle corresponding to the number of pixels n in the horizontal direction. The signals SP1 through SPn are supplied to corresponding sampling transistors SPt1 through SPtn and the sampling transistors SPt1, SPt2, . . . SPtn are sequentially switched on by the sampling signals. When the sampling transistors are switched on, a digital data signal Sig output to the data line 62 is sampled and is supplied to each of the drain lines 61. operation of the display pixels on the first row, that is, display pixels P11 through P1*n* connected to a gate line GL1 to which a gate signal G1 is applied, will now be described.

First, when the gate signal G1 is output through the gate line GL1, each of the TFTs 70 in each of the display pixels P11 through P1*n* connected to the line GL1 is switched on for one horizontal scan period.

Looking at the pixel electrode P11 on the first row, first column, a digital signal S11 which has been sampled at the output duration of the sampling signal SP1 is being supplied to the drain line 61 of the first column. Therefore, when the TFT 70 of the pixel P11 is switched on by the gate signal G1, the drain signal D1 is input to the storing circuit 110 via the TFT 70.

The storing circuit 110 stores the input drain signal D1, as will be described in detail later, and the stored signal is input to the signal selector 120 where either signal A or signal B is selected in response to the stored signal. The selected signal A or B is then applied to the display electrode 80 where the liquid crystal (or its alignment) between the display electrode 80 and the facing electrode 32 is controlled based on the applied voltage.

Similarly, drain signals are supplied to the remaining display pixels in the first row, P12 through P1*n*, where corresponding signal A or B is applied to the display electrode 80 and the liquid crystal is controlled. By executing similar control for the gate lines GL1 through GLm, which correspond to the last row, a scan for one screen (one field period), that is, a full dot scan, is completed and one screen is displayed.

In the first embodiment, when data for one screen is written to all of the pixels as described above, that is, when a screen is displayed, voltage supplies to the gate driver 50, drain driver 60, and external LSI 91 for driving the panel are stopped to stop the operation of these components. The storing circuit 110 of each of the display pixels, on the other hand, is constantly supplied with voltages VDD and VSS to continue the data storage operation. VCOM is supplied to the facing electrode 32, as is normally done, and supply of each of the signals A and B to the selector 120 of each of the display pixels is also continued.

In other words, voltages VDD and VSS for driving the storing circuit 110 are supplied to the storing circuit 110 and the facing electrode voltage VCOM (signal A) which is a direct current voltage is applied to the facing electrode. When the liquid crystal display panel 100 is of the normally white (NW) type, the voltages supplied as the signal A and for the facing electrode 32, while an alternating current voltage (for example at 60 Hz) which is to be supplied to the selector 120 and for driving the liquid crystal is applied as the signal B. With this configuration, even when the drivers are stopped, the white display pixels can maintain a white display by continuing to supply the signal A to the electrode 80 and a still image screen display can be maintained. No voltage is then applied to the gate driver 50, drain driver 60, and the external LSI 91. When a normally black type display is employed, signal B can be selected and applied to the display electrode 80 for a white display.

When a digital signal which output through the drain line 61 is input to the storing circuit 110 at "H (high)" level via the TFT 70, a signal at "L (low)" level is input to the first TFT 121 at the signal selector 120, and thus, the first TFT 121 is switched off. Similarly, a signal at "H" level is input to the second TFT 122, and thus, the second TFT 122 is switched on. As a consequence, signal B is selected at the selector 120 and a voltage corresponding to signal B is applied to the liquid crystal. That is, the alternating current voltage of signal B is applied and the liquid crystal stands up by an electric field, resulting in a black display for that particular pixel in a NW type display panel.

When a digital signal which is output to the drain line 61 is received at the storing circuit 110 at "L" level, a signal at "H" level is input to the first TFT 121 of the signal selector 120, and, thus, the first TFT 121 is switched on. A signal at "L" level is input to the second TFT 122, on the other hand, and thus, the second TFT 122 is switched off. As a consequence, signal A is selected and a voltage of signal A is applied to the liquid crystal. That is, a voltage identical to that of the facing electrode 32 is applied to the liquid crystal, no electric field is generated, the liquid crystal does not stand up, and, in a NW type display panel, a white display is observed at that particular pixel.

In this manner, a still image can be displayed by writing a single screen image and then storing that image while the operations of the drivers 50 and 60 and LSI 90 are stopped, and thus, the power consumption can be reduced.

Thus, with the display apparatus of the present invention, the overall power consumption can be reduced. Because of this, the display apparatus of the present invention can be preferably used for a portable apparatus using a limited power source such as a battery, including, for example, a portable television and portable phone. Display time can be lengthened because the power consumption is reduced.

It is also preferable that the display apparatus of the present invention be embodied in a reflection type liquid crystal display apparatus. A device structure for a reflection type liquid crystal display apparatus will now be described while referring to FIG. 3.

Figure 3:
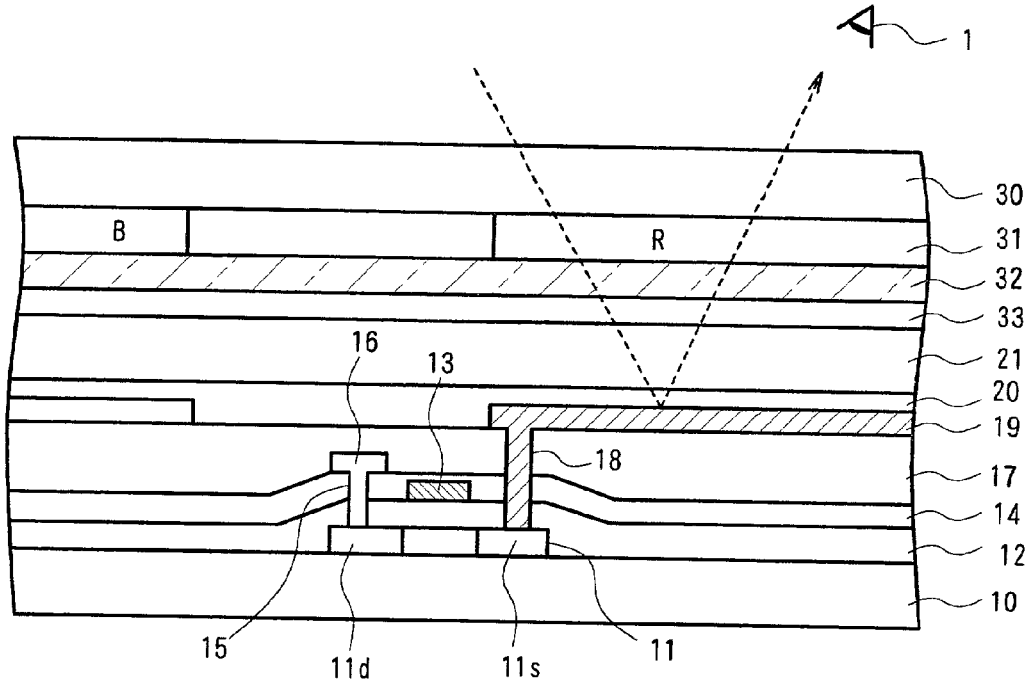
FIG. 3 is a cross sectional diagram of a reflection type liquid crystal display apparatus.

A liquid crystal display apparatus has a first substrate and a second substrate bonded together with a predetermined gap in between and liquid crystal fills the gap between the first and second substrates. In an active matrix type liquid crystal display apparatus, a TFT is formed on one of the first or the second substrate. In FIG. 3, the TFT is formed on an insulating substrate 10. Specifically, an island-shaped semiconductor layer 11 formed from a polycrystalline silicon is formed on top of the substrate 10 and a gate insulating film 12 is formed on top of the semiconductor layer 11. A gate electrode 13 is formed on top of the gate insulating film 12 above the semiconductor layer 11.

At the region of the semiconductor layer 11 corresponding to both sides of the gate electrode 13, a source 11*s* and a drain 11*d* are formed. On the gate electrode 13 and gate insulating film 12, an interlayer insulating film 14 is formed. A contact hole 15 is provided at the region corresponding to the drain 11*d* on the interlayer insulating film 14 and the gate insulating film 12, to penetrate through these layers. The drain 11*d* is connected to a drain electrode 16 via the contact hole 15. The drain electrode 16 and interlayer insulating film 14 are further covered by a planarizing insulation film 17, and a contact hole 18 is formed at the region corresponding to the source 11*s* on the planarizing insulation film 17, the interlayer insulating film 14, and the gate insulating film 12 to penetrate through these layers. The source 11*s* is connected to a display electrode 19 via the contact hole 18.

Each of the display electrodes 19 formed on top of the planarizing insulation film 17 are constructed from a reflective material such as aluminum (Al). Alignment films 20 are formed on each of the display electrodes 19 and planarizing insulation film 17, constructed from polyimide or the like, for aligning the liquid crystal 21.

Color filters 31 for providing each of red (R), green (G), and blue (B) colors, a facing electrode 32 constructed from a transparent conductive film such as an ITO (Indium Tin Oxide), and alignment film 33 for aligning the liquid crystal 21 are formed in that order on the other insulating substrate 30. When color display is not desired, the color filters 31 can be removed.

The pair of insulating substrates 10 and 30, each of which is formed as described above, are adhered to each other at their periphery by a adhering sealing member, and the gap formed by the adhesion of the pair of insulating substrates is filled with liquid crystal. Construction of a reflection type liquid crystal display apparatus is thus completed.

As indicated by a dotted arrow in the figure, in the reflection type liquid crystal display, external light incident from an observer 1 side enters the apparatus from the opposing electrode substrate 30, reflected at the display electrodes 19, and exits to the observer 1 side, where the observer 1 can observe the display.

As described above, the reflection type liquid crystal display apparatus employs a method to reflect the external light to observe a display. Because a backlight at the side opposite of the observer side, as in a transmission type liquid crystal display apparatus, is unnecessary there is also no need to supply power to light the backlight. Therefore, by applying the present invention on a reflection type liquid crystal display apparatus without a backlight, power consumption in the reflection type liquid crystal display apparatus can be further be reduced and the resulting apparatus will be advantageous as a monitor for any device for which low power consumption is a desired feature.

When the display screen is to be rewritten, gate driver 50, drain driver 60, and LSI 91 for driving the panel can again be operated for writing a further single screen data signal, and then the operation of these components can be stopped. The written still image can be a real still image such as a photograph and a background image, or a semi-still image such as, for example, a display for the remaining amount of battery in a portable phone by a plurality of segments, where the segments corresponding to the remaining amount are only altered when the amount of battery power remaining changes.

In the above embodiment, an example is described wherein the facing electrode voltage and the voltages for signals A and B are not applied during the full dot scan period for one screen. The present invention is not limited to such a configuration and these voltages can be applied during the full dot scan period. However, from the standpoint of reducing power consumption, it is preferable not to apply the voltages.

Also in the above-described example, a one-bit digital data signal is input. The present invention, however, is not limited to such a configuration and can be applied for a case where a digital data signal having a plurality of bits is used. In this manner, a multiple gray scale display can be achieved. In such a case, the numbers of the storing circuits and signal selectors must be changed to correspond to the number of input bits.

ALTERNATE STORING CIRCUIT CONFIGURATION

Figure 4:
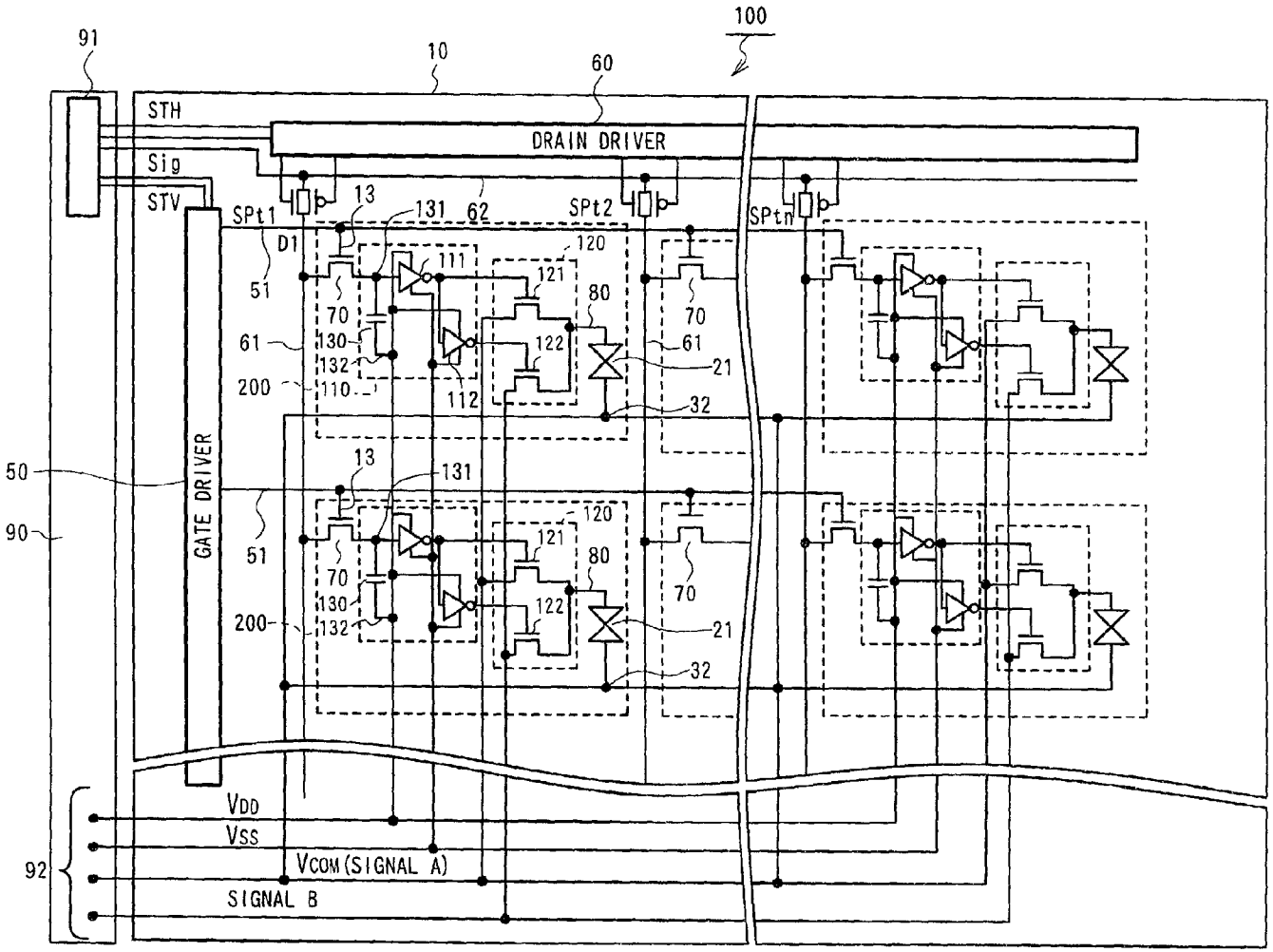
FIG. 4 is an equivalent circuit diagram of a liquid crystal display apparatus according to a second embodiment of the present invention.

A liquid crystal display apparatus according to a second embodiment of the present invention will now be described. While in the first embodiment as described above, the storing circuit is configured to employ an inverter circuit, in the second embodiment, as shown in FIG. 4, the storing circuit 110 comprises two serially connected inverter circuits and a capacitor 130.

One electrode 131 of the capacitor 130 is connected to the source 11*s* and the other electrode 132 is connected to VDD, which is also a power source for the inverter circuits 111 and 112. The second electrode 132 can be connected to a line for supplying voltage VSS or voltage VCOM.

The structure and driving method for components other than the storing circuit 110 are identical to those employed in the first embodiment, and will not be described again.

In this second embodiment, the drain signal supplied from the drain line 61 to the source 11*s* of the TFT 70 is accumulated in the capacitor 130. The drain signal is also input to the inverter 111, and the output signal from the inverter 111 is supplied to the other inverter 112 and to the gate of the first TFT 121 of the signal selector 120. The other inverter 112 inverts the output signal from the inverter 111 and outputs the inverted signal to the gate of the second TFT 122 in the signal selector 120.

The drain signal supplied via the TFT 70 is stored by the capacitor 130 and a selected signal is output from the inverters 111 and 112 based on the stored data. With a storing circuit 110 of such structure, the data signal can be stored similar to the storing circuit of FIG. 2A.

The operation of the selector 120 is identical to that for the first embodiment, and thus, the display apparatus of the second embodiment can display a still image even when the drivers 50 and 60 are not operated. By halting operation of the drivers 50 and 60 and LSI 91 after a single screen is written, the power consumption can be reduced.

Digital Signal Input With a Plurality of Bits

A third embodiment of a display apparatus according to the present invention will now be described. In this third embodiment, a multi-bit digital data signal is input.

Figure 5:
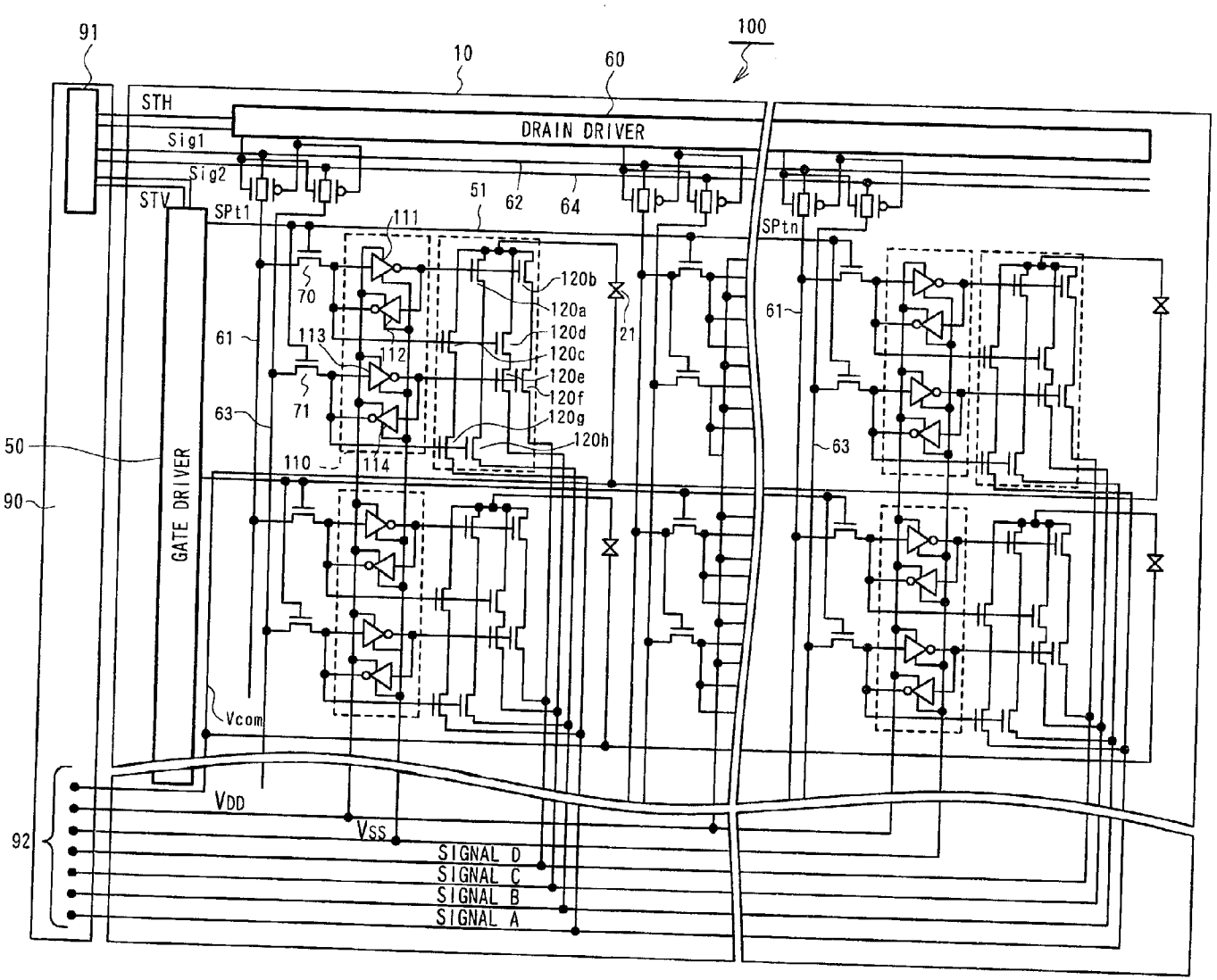
FIG. 5 is an equivalent circuit diagram of a liquid crystal display apparatus according to a third embodiment of the present invention.

FIG. 5 shows a circuit configuration of the display section of a liquid crystal display apparatus to which a two-bit digital data is input.

A difference from the equivalent circuit of the liquid crystal display apparatus depicted in FIG. 2A is that the digital data signal to be input is a two-bit signal. The two-bit signal is input from the LSI 91 on the data lines 62 and 64, and sampled by sampling transistors SPt, two of which are provided for every column. Data signals (two-bit digital signal) are supplied to two drain lines 61 and 63, each of which is connected to one of the sampling transistors SPt. In order to store the two-bit signal supplied by the drain lines 61 and 63, the storing circuit 110 at each display pixel includes two pairs of inverters 111 and 112, and 113 and 114. The selector 120 at each display pixel is constructed to include eight n-ch type transistors so that four signals A through D can be selectively supplied to the display pixel 80.

The operation of the circuit selector 120 will now be described.

When a two-bit data signal, "11", is input, a signal at "H (high)" level is input from both drain lines 61 and 63. A signal at "L (low)" level is applied from each of the inverters 111 and 113 of the storing circuit 110 to the gates of transistors 120*a*, 120*b*, 120*e*, and 120*f*, and consequently, these transistors 120*a*, 120*b*, 120*e*, and 120*f* are not switched on. On the other hand, a signal at "H" level is applied from each of the inverters 112 and 114 to the gates of transistors 120*c*, 120*d*, 120*g*, and 120*h*, and consequently, the transistors 120*c*, 120*d*, 120*g*, and 120*h* are switched on. Because transistors 120*g* and 120*c* which are provided between the supply line of signal A and the display pixel, are both switched on, signal A is selected and a voltage corresponding to signal A is supplied to the liquid crystal 21.

When the two-bit data signal is "10", for example, a signal at "H" level is supplied on the drain line 61 and a signal at "L" level is supplied on the drain line 63. In this case, the transistors 120*d* and 120*e* which are provided between the supply line of signal C and the display pixel are both switched on, and a voltage corresponding to signal C is applied to the liquid crystal. When the two-bit data signal is "01", a signal at "L" level is input from the drain line 61 and a signal at "H" level is input from the drain line 63. In this case, transistors 120*a* and 120*h* are switched on, signal B is selected, and a corresponding voltage is applied to the liquid crystal. When the two-bit data signal is "00", a signal at "L" level is input on both drain lines 61 and 63. In this case, transistors 120*b* and 120*f* are switched on, signal D is selected, and corresponding voltage is applied to the liquid crystal. Each of the signals A, B, C, and D are set at a different voltage level for allowing a four gray scale display.

In this manner, by selecting one signal from among four signals at different voltage levels at the selector 120 based on the digital signal stored in the storing circuit 110 and by applying a voltage corresponding to the selected signal to the liquid crystal 21, a four gray scale still image display can be obtained.

With such a configuration, similar to the example one-bit signal configurations shown in FIGS. 2A and 4, it is possible to stop the operations of the drivers 50 and 60 and LSI 91 after writing one-screen worth of image to reduce the power consumption.

Transition Between Analog and Still Image Display

A fourth preferred embodiment of the present invention will now be described.

Figure 6:
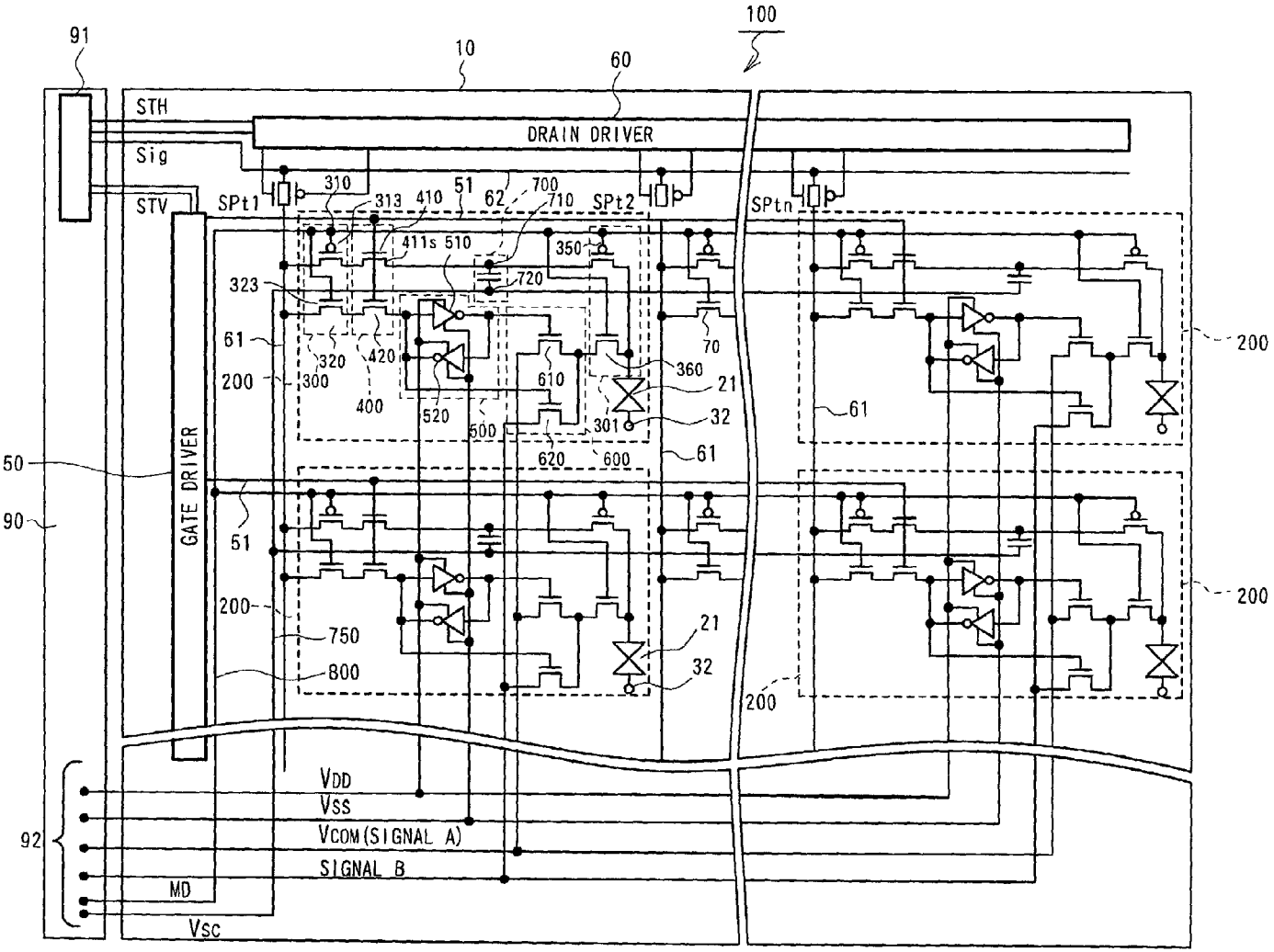
FIG. 6 is an equivalent circuit diagram of a liquid crystal display apparatus according to a fourth embodiment of the present invention.

FIG. 6 shows a circuit configuration of a display apparatus according to the fourth embodiment of the present invention, using an example applied to a liquid crystal display apparatus.

A plurality of gate lines 51 are provided in one direction of an insulating substrate 10. The gate lines 51 are connected to a gate driver 50 for supplying scan signals. A plurality of drain lines 61 are also provided on the substrate 10 in a direction intersecting with the gate lines 51.

A data signal from data line 62 (an analog image signal or a digital image signal) is supplied on the drain line 61 by turning sampling transistors SPt1 through SPtn on in response to sampling pulses which are output from a drain driver 60.

On a liquid crystal display panel 100, a plurality of display pixels 200 are provided in a matrix form, which is selected by a scan signal from the gate line 51 and which is supplied with data signals from the drain line 61.

An example configuration of the display pixel 200 will now be described in detail.

A circuit selector (display circuit selector) 300, which includes a p-channel type TFT 310 and an n-channel type TFT 320, is provided near the cross section of a gate line 51 and a drain line 61. Both of the drains of the TFTs 310 and 320 are connected to the drain line 61 and both of the gates 313 and 323 of the TFTs 310 and 320 are connected to a selecting line 800. One of the TFTs 310 and 320 is switched on in response to the selecting signal from the selecting line 800. As will be described below, a data selector 301 paired with the circuit selector 300 is provided for selecting one of the analog and digital data to output to the display electrode 80.

By adding the circuit selector 300 and A/D data selector 301 as described above to each of the display pixel components in any of the above embodiments, selection and switching between the analog image signal display (correspond to full color animated image display) and the digital image display (correspond to a power saving display and a still image display) can be enabled. A pixel selector 400 constructed from an n-channel type TFT 410 and an n-channel type TFT 420 are provided adjacent to the circuit selector 300. The drains of the TFTs 410 and 420 are connected to the sources of respective TFTs 310 and 320 of the circuit selector 300. In other words, the TFTs 410 and 420 are respectively connected to the drain line 61 via the TFTs 310 and 320. The gates of the TFTs 410 and 420 are connected to the gate line 51. TFTs 410 and 420 are configured so that they are simultaneously switched on in response to a scan signal from the gate line 51.

A storage capacitor 700 is further provided for storing the analog image signal. One electrode 710 of the storage capacitor 700 is connected to the source 411*s* of the TFT 410 and the other electrode 720 is connected to a common storage capacitor line 750 within the panel 100. A bias voltage Vsc is supplied to the electrode 720. During the period when the gate of the TFT 410 is opened, the analog image signal supplied from the drain line 61 is applied to the liquid crystal 21. However, this signal must be maintained for one field period until the TFT 410 is again switched on and the gate is opened. The capacitance of the liquid crystal 21 is not enough to store the signal, and consequently the voltage applied to the liquid crystal 21 is reduced as time passes. This leads to uneven display, and thus, degradation of display quality. In order to maintain the voltage corresponding to the signal supplied when the TFT 410 is switched on for a duration of one full field, a storage capacitor 700 is provided.

A p-channel type TFT 350 of a data selector 301 is provided between the storage capacitor 700 and the liquid crystal 21, and is configured to be switched on and off simultaneously with the TFT 310 of the circuit selector 300.

A storing circuit 500 and a signal selector 600 are provided between the TFT 420 of the pixel selector 400 and the display electrode 80 of the liquid crystal 21. The storing circuit 500 includes two positively feedbacked inverter circuits 510 and 520, and, thus, forms a static type memory for storing a digital binary value. The configuration of the storing circuit 500 is identical to, for example, the storing circuit 110 depicted in FIG. 2A for the first embodiment.

The signal selector 600 is a circuit for selecting a signal in response to a signal from the storing circuit 500, and includes two n-channel type TFTs 610 and 620. The configuration of the signal selector 600 is identical to, for example, the signal selector 120 depicted in FIG. 2A. Each of the output signals that compliment each other from the storing circuit 500 is applied to each of the gates of the TFTs 610 and 620, and thus, TFTs 610 and 620 switch on and off in a complimentary fashion.

When a digital data at "H" level is applied from the drain line 61 to the gate of the TFT 620 via TFT 320, TFT 420, and storing circuit 500, the TFT 620 is switched on, and a facing electrode signal VCOM (signal A), being a direct current voltage, is selected. When, on the other hand, a digital data at "L" level is supplied from the drain line 61, TFT 610 is turned on, and an alternating current driving signal (signal B) for driving the liquid crystal is selected, the signal being an alternating current oscillating around the facing electrode signal VCOM. The selected signal is then supplied to the display electrode 80 of the liquid crystal 21 via the TFT 360 of the data selector 301.

In summary, two circuits are provided within one display pixel 200, one being an analog data circuit (first display circuit) including a pixel selecting element, TFT 410, and a storage capacitor 700 for storing an analog image signal, and the other being a digital data circuit (second display circuit) including a pixel selecting element, TFT 420, a storing circuit 500 for storing a binary digital image signal, and a signal selector 600. A circuit selector 300 is provided near the cross section between a gate line 51 and a drain line 61 for selecting one of the two circuits based on a switching signal MD, that is, for selecting a circuit to which data signal is to be supplied based on the signal MD. A data selector 301 is provided between the two display circuits and the display electrode 80 for selecting a display circuit from which data is supplied to the electrode 80, based on the signal MD.

Peripheral circuits on the liquid crystal panel 100 will now be described.

An LSI 91 for driving the panel is provided on the external circuit board 90. A vertical start signal STV is input from the panel driving LSI 91 of the external circuit board 90 to the gate driver 50. Similarly, a horizontal start signal STH is input to the drain driver 60 from the LSI 91. An image signal, which can be either analog or digital, is input to the data line 62.

Figure 7:
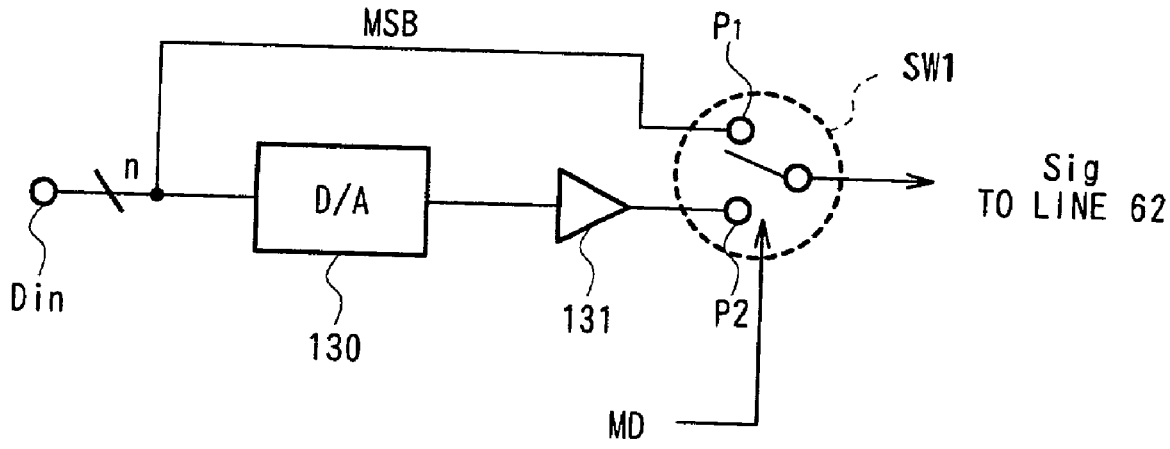
FIG. 7 is an equivalent circuit diagram of a signal switching circuit for the display apparatus of the present invention.

FIG. 7 shows a circuit configuration of a switching circuit for the image signals.

When a switch SW1 is connected to a terminal P2, an n-bit digital image signal input from an input terminal Din is converted to an analog image signal by a D/A converter 130 and is output on the data line 62 via the switch SW1. When the switch SW1 is switched to a terminal P1, on the other hand, the most significant bit [MSB], for example, of the n-bit digital image signal is output on the data line 62. The switching of the switch SW1 is performed based on a mode signal MD for controlling the switching between an analog latch display mode and a digital latch display mode corresponding to a low power consumption.

A method of driving the display apparatus according to the fourth embodiment of the present invention will now be described while referring to FIGS. 6 and 7. Operations similar to those already described for the first embodiment above will not be again described in detail.

(1) Analog Display Mode

When an analog display mode is selected in response to the mode signal MD, a condition is set where an analog image signal can be output on the data line 62, and, at the same time, the voltages of the circuit selecting line 800 and power supply line at the high voltage side VDD become "L" and TFTs 310 and 350 of the circuit and data selectors 300 and 301, respectively, are switched on.

Sampling transistors SPt are turned on in response to the sampling signal based on the horizontal start signal STH, and, thus, the analog image signal on the data line 62 is supplied to the drain line 61.

A scan signal (gate signal) is supplied on the gate line 51 in response to a vertical start signal STV. When TFT 410 is switched on in response to the scan signal, an analog image signal Sig is transmitted from the drain line 61 to the display electrode 80 via a transistor 350 which is being controlled to be at an ON condition, and at the same time, the analog image signal is stored in the storage capacitor 700. The image signal voltage applied to the display electrode 80 is applied to the liquid crystal 21, and a liquid crystal display can be obtained by the liquid crystal aligning itself based on the applied voltage.

The analog display mode is suited for display of a full color animated image. However, because with an animated image display, the LSI 91 of the external circuit board 90 and drivers 50 and 60 must constantly driven, power is constantly consumed.

(2) Digital Display Mode

When a digital display mode is selected in response to the mode signal MD, a condition is set where a digital image signal can be output through the data line 62, and at the same time, the voltage at the circuit selecting line 800 and the power supply line at the high voltage side VDD become "H" level, and the storing circuit 500 becomes operable. The TFTs 310 and 350 of the circuit and data selectors 300 and 301 are switched off and the TFTs 320 and 360 are turned on.

Respective start signals STV and STH are input from the panel driving LSI 91 of the external circuit board 90 to the gate driver 50 and the drain driver 60. In response to the start signals, sampling signals are sequentially generated, causing corresponding sampling transistors SPt1 through SPtn to be switched on, and the digital image signal Sig is sampled and supplied to each of the drain lines 61.

Operation at the display pixel connected to a gate line 51 at the first row, that is, the gate line 51 to which a scan signal G1 is applied, will now be described. First, in response to the scan signal G1, each of the TFTs 410 and 420 of each of the display pixels P11 through P1*n* connected to the gate line 51 is switched on for the duration of one horizontal scan period.

Looking at the display pixel P11 in the first row, first column, a digital image signal S11 which has been sampled by the sampling signal SP1 is input to the drain line 61. When the TFT 420 is turned on by the scan signal G1, the drain signal D1 is input to the storing circuit 500 via the TFT 320 and TFT 420.

The signal (H or L) stored at the storing circuit 500 is then supplied to the signal selector 600. The signal selector 600 selects either signal A or signal B based on the data output from the storing circuit 500, similar to the signal selector 120 in the first embodiment. The selected signal is applied to the display electrode 80 and the liquid crystal 21 is controlled based on the applied signal.

A similar process is executed for each of the pixels P12 through P1*n* at the first row. By scanning from the gate line 61 at the first row (GL1) through the gate line 61 at the last row (GLm), a one-screen worth (one field period) of scan, that is, a full dot scan is completed and a full screen is displayed.

When one screen is displayed, voltage supplies to the gate driver 50, drain driver 60, and external panel driving LSI 91 are stopped and their operations are halted. The storing circuit 500 is constantly operated by supplying voltages VDD and VSS. Facing electrode voltage VCOM is constantly supplied to the facing electrode 32 and the signals A and B are constantly supplied to the selector 600.

For example, when a signal at "H" level is supplied from the drain line 61 to the storing circuit 500 as a digital image signal, the first TFT 610 of the signal selector 600 is switched off, and the second TFT 620, on the other hand, is switched on.

Signal B is then selected and applied to the display electrode 80. Similarly as in the first embodiment, signal B is an alternating current voltage signal oscillating around VCOM. When signal B is selected, the liquid crystal is driven and, in an NW type display panel, a black display is produced.

To the contrary, when a signal at "L" level is input from the drain line 61 to the storing circuit 500 as the digital image signal, the TFT 610 of the signal selector 600 is switched on and the TFT 620 is switched off. Signal A is then selected and applied to the display electrode 80. Signal A has a voltage identical to VCOM. When signal A is selected, no voltage is applied to the liquid crystal, and thus, in an NW type display panel, white is displayed.

In this manner, by writing a full screen image and then maintaining the image, a still image can be displayed while operation of the drivers 50 and 60 and LSI 91 are stopped. The power consumption can thus be reduced.

In the preferred embodiments of the present invention as described above, by providing two display circuits, a circuit selector 300, and a data selector 301 within single display pixel and by executing selection operation at the selectors 300 and 301, the display apparatus can accommodate both full color animated image display (analog display mode) and low power digital gradation display (digital display mode).

The present invention can also accommodate two display modes, both full color animated image display (analog display mode) and low power digital gradation display (digital display mode), on a single liquid crystal display panel 100, even with a configuration other than that described in the example of the fourth embodiment. Configurations wherein the configuration of the fourth embodiment is modified will now be described as a fifth and a sixth preferred embodiment of the present invention.

Figure 8:
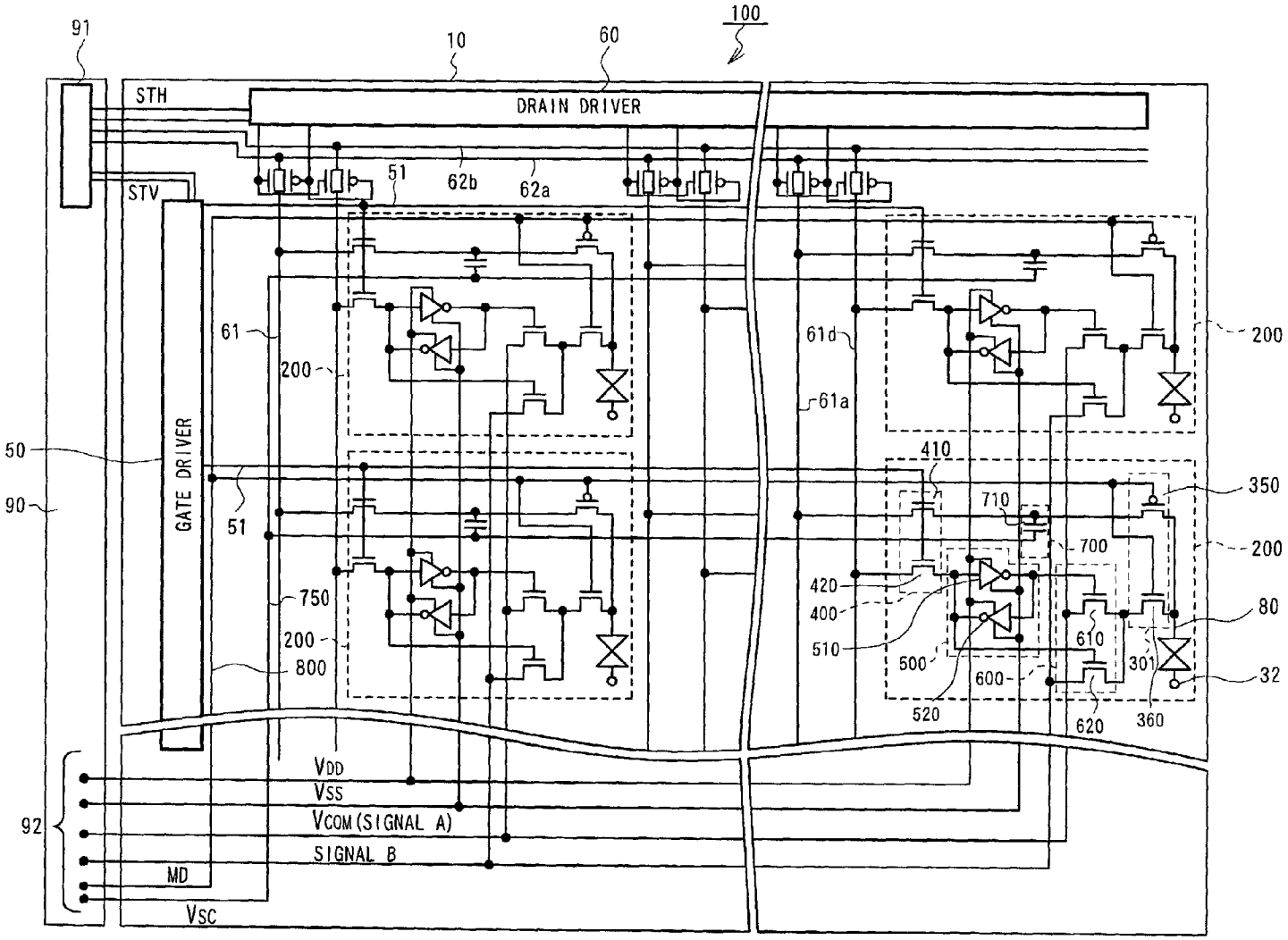
FIG. 8 is an equivalent circuit diagram of a liquid crystal display apparatus according to a fifth embodiment of the present invention.

FIG. 8 shows an exemplary configuration of a liquid crystal display apparatus according to a fifth embodiment of the present invention.

The equivalent circuit shown in FIG. 8 differs from that of FIG. 6 used to describe the fourth embodiment in that the configuration of FIG. 6 does not have circuit selectors 300 provided in each pixel in the configuration of FIG. 6, and in that full color animated image display signal and digital gradation display signal are supplied by respective dedicated lines 62*a* and 62*d*.

In the present embodiment, the analog and digital signals are supplied to the panel by separate data lines 62*a* and 62*d*. These analog and digital lines are then separately supplied to each of the pixels 200 by two drain lines 61*a* and 61*d*. As a result, it is not necessary to provide a circuit selector in each of the pixels 200. In other words, the p-channel type TFT 310 and n-channel type TFT 320 which are provided in each display pixel 200 in the fourth embodiment can be removed, and, thus, the size of the display electrode 80 within one pixel 200 can be increased, or additional TFTs can be provided, though the number of data lines (62*a* and 62*d*), sampling transistors (SPt), and drain lines (61*a* and 61*d*) then increases. However, the TFTs 310 and 320 must be provided in each display pixel, and the overall space they occupy is far greater than the space occupied by the extra data lines 62, sampling transistors SPt, and drain lines 61. Therefore, by supplying the digital and analog signals on dedicated data lines 62 to the liquid crystal display panel, sufficient space can be secured at the display pixels.

An example configuration of a liquid crystal display apparatus according to a sixth preferred embodiment of the present invention will now be described while referring to FIG. 9.

Figure 9:
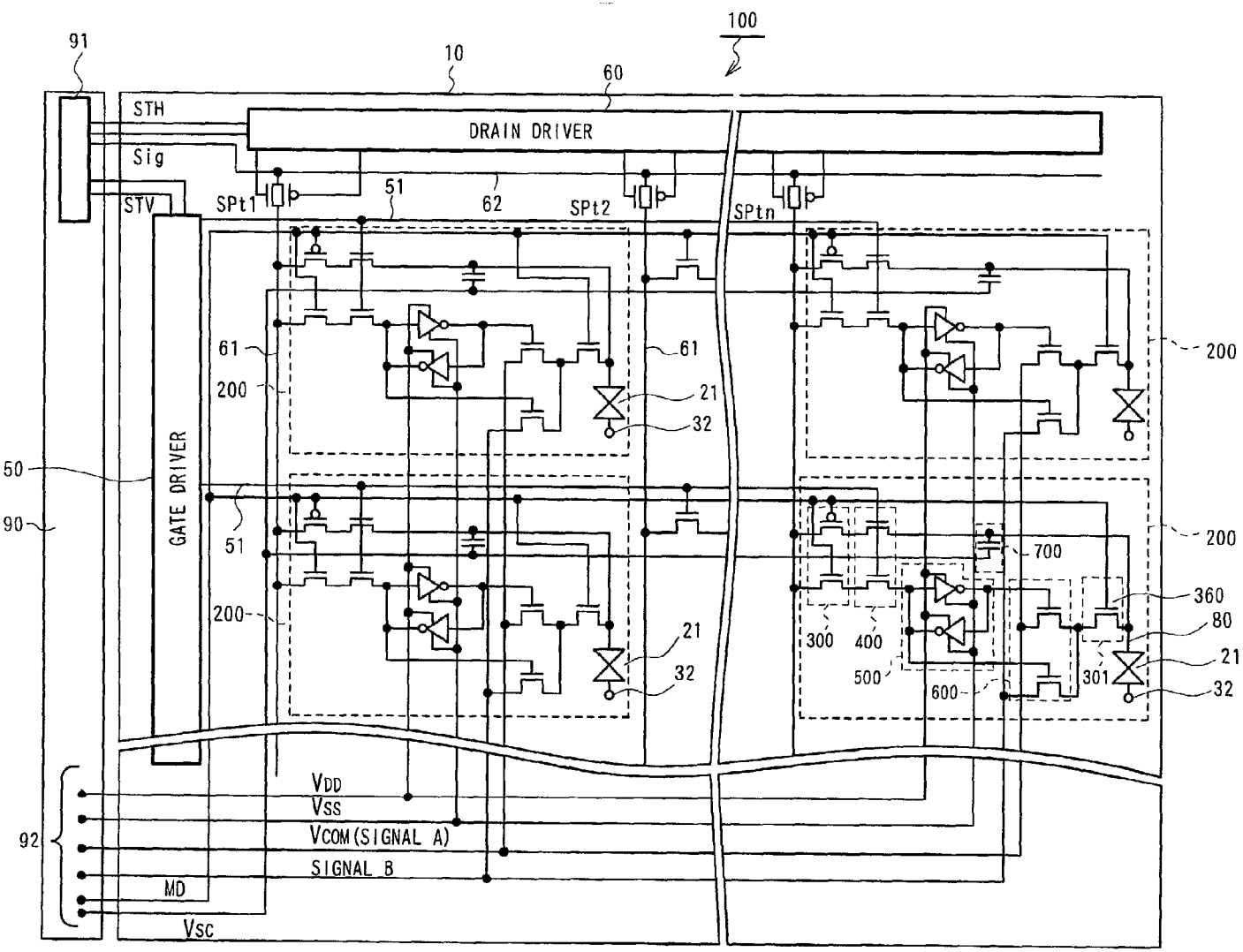
FIG. 9 is an equivalent circuit diagram of a liquid crystal display apparatus according to a sixth embodiment of the present invention.

The equivalent circuit configuration shown in FIG. 9 differs from the configuration depicted in FIG. 6 in the absence of the TFT 350 included in the data selector 301.

Figure 10:
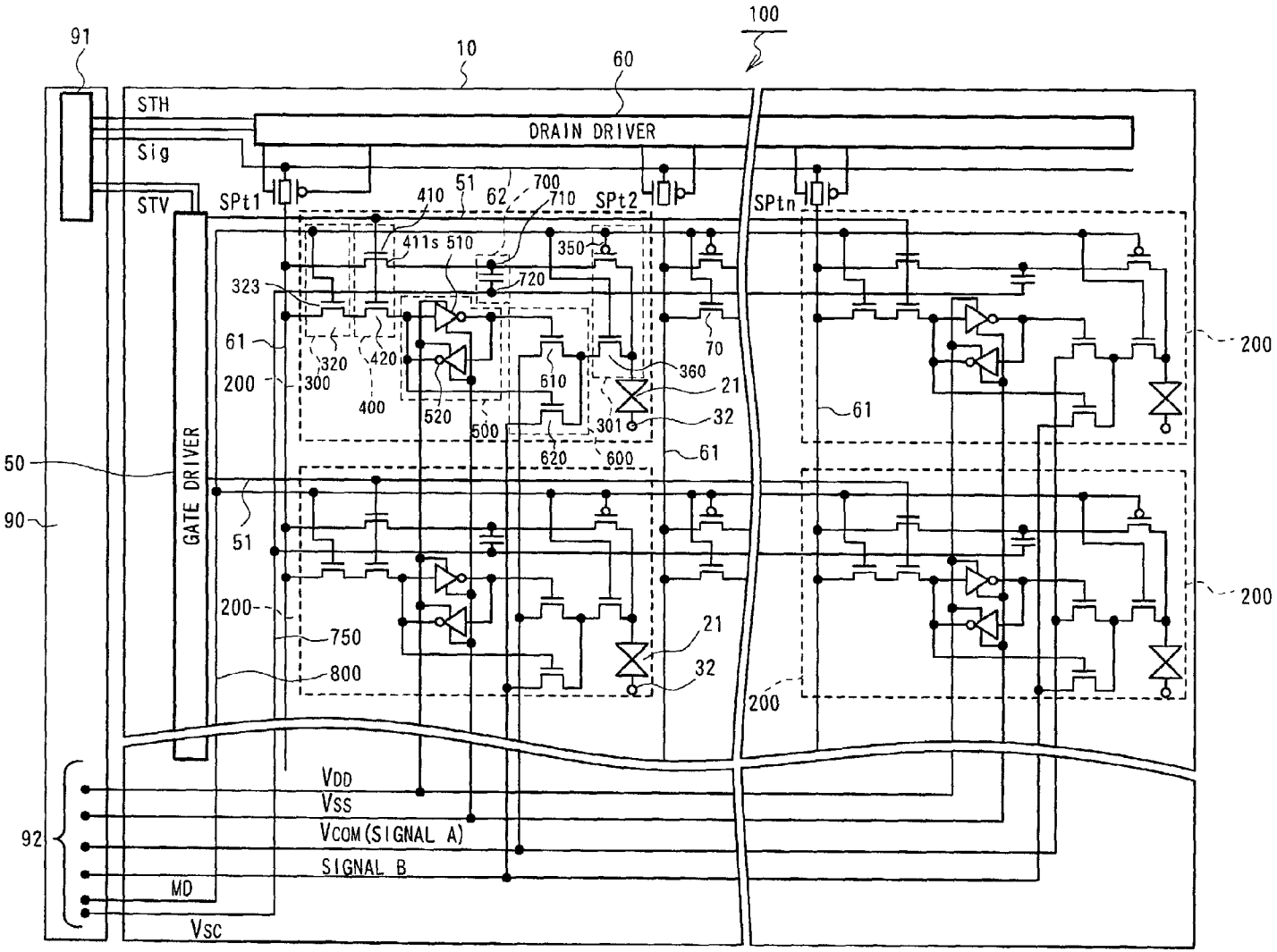
FIG. 10 is a diagram showing an alternate example of a circuit depicted in FIG. 9.

In FIG. 6, TFTs 350 are provided on each display pixels. By eliminating these TFTs, as in the present embodiment, a larger space within a display pixel can be secured, allowing a greater number of TFTs to be installed in a same area. Even when the TFT 350 of the data selector 301 is removed, when the power supply for the signals A and B have enough charge supplying capability for charging signals to be supplied to the storage capacitor 700 and to the liquid crystal, the liquid crystal can be driven while the storage capacitor is charged. While in the above example, the TFT 350 is removed, the present invention is not limited to such a configuration, and it is, for example, also possible to remove TFT 310 of the circuit selector 300 as shown in FIG. 10. Even when TFT 310 is eliminated, when the power supply for the digital signals to be outputted to the drain line 61 has sufficient charge supplying capability for charging signals to be supplied to the storage capacitor 700 and to the storing circuit, the storing circuit can be charged while the storage capacitor is charged by the power source of the digital signals. Moreover, the TFT 350 of the data selector 301 can be removed from the example configuration of the above fifth embodiment, similar to the sixth embodiment, so that further space is secured within one pixel.

In the above first through sixth embodiments, examples are shown wherein voltages such as the facing electrode voltage VCOM, voltage for the signal A, and voltage for the signal B, continued to be applied during the full dot scan period for one screen. However, the present invention is not limited to such configurations, and the voltages need not be applied during the full dot scan period. In general, it is preferable not to apply these voltages when it is desired to reduce the power consumption.

In the above first, second, and fourth through sixth embodiments, examples are shown wherein a one-bit digital data signal is input in the digital display mode. However, the present invention is not limited to such configurations and, as shown in the third embodiment, for example, the present invention can also be applied to a case where a digital data signal having a plurality of bits is input to the panel. In this manner, a multiple gray scale display can be enabled. In this case, the number of components in the storing circuits and in the signal selectors must be changed to correspond to the number of bits in the input signal.

In the above first through sixth embodiments, the still image can be displayed either partially or fully on one screen of the liquid crystal display panel without disrupting the operation of the display apparatus, and the same advantage can be obtained in either case.

While in the description of the above embodiments, examples are described wherein a reflection type liquid crystal display apparatus is used, by providing a transparent electrode as a display electrode 80 within one pixel in the region remaining after placing the TFTs, storing circuits, signal selectors, and signal lines, the present invention can also be applied to a transmission type liquid crystal display apparatus.

Moreover, the present invention can also be applied to a semi-transmission type liquid crystal display apparatus by providing a transparent electrode within the pixel in the region remaining after placing the TFTs, storing circuits, signal selectors, and signal lines, and providing a reflection type electrode on the remaining regions. When the present invention is applied to either the transmission type or semi-transmission type liquid crystal display apparatus, power consumption can be reduced by suspending the voltage supply to the gate driver 50, drain driver 60, and external panel driving LSI 91 after the display of one screen.

What is claimed is:

1. A display apparatus, comprising:

a plurality of gate lines provided in one direction of a substrate;

a plurality of drain lines provided in a direction intersecting with said gate lines; and a plurality of display pixels, each of which is selected by a scan signal supplied from corresponding one of said plurality of gate lines, and which is supplied with an image signal from corresponding one of said plurality of drain lines; wherein each of said plurality of display pixels comprises:

a display element;

a first display circuit having a storing circuit, for storing a digital image signal from said corresponding one of drain lines in response to a scan signal from said corresponding one of gate lines, and a signal selector which is operated based on data stored at said storing circuit for selecting an output signal from among two or more display signals and supplying said selected signal to said display element; and a second display circuit having a storage capacitor for storing an analog image signal from said corresponding one of drain lines in response to a scan signal from said corresponding one of gate lines, wherein the signal stored in said storage capacitor is supplied to said display element;

wherein said display pixel further comprises a display circuit selector for selectively supplying an image signal from said corresponding one of drain lines to said first or second display circuit;

and further including an output selector which selectively supplies data stored in one of said first display circuit and said second display circuit to said display element.

2. A display apparatus, comprising:

a plurality of gate lines provided in one direction of a substrate;

a plurality of drain lines provided in a direction intersecting with said gate lines; and a plurality of display pixels, each of which is selected by a scan signal supplied from corresponding one of said plurality of gate lines, and which is supplied with an image signal from corresponding one of said plurality of drain lines; wherein each of said plurality of display pixels comprises:

a display element;

a first display circuit having a storing circuit, for storing a digital image signal from said corresponding one of drain lines in response to a scan signal from said corresponding one of gate lines, and a signal selector which is operated based on data stored at said storing circuit for selecting an output signal from among two or more display signals and supplying said selected signal to said display element; and a second display circuit having a storage capacitor for storing an analog image signal from said corresponding one of drain lines in response to a scan signal from said corresponding one of gate lines, wherein the signal stored in said storage capacitor is supplied to said display element;

wherein said display pixel further comprises a data selector for selectively supplying an output signal from said first or second display circuit to said display element.

3. A display apparatus of claim 1, wherein said storing circuit comprises a predetermined number of storing elements, said number corresponding to the number of bits in said digital image signal; and said signal selector selects a signal to be supplied to said display element from among a predetermined number of signals, said number corresponding to the number of bits in said digital image signal.

4. A display apparatus of claim 1, wherein, said storing circuit stores said digital image signal using one or more inverters.

5. A display apparatus of claim 1, wherein said storing circuit stores said digital image signal using one or more inverters and a capacitor.

6. A display apparatus of claim 1, wherein, said plurality of display pixels is capable of displaying a still image.

7. A display apparatus of claim 1, wherein, after a still image is written to each of said plurality of display pixels as a digital image signal, operations of driving circuits for driving said plurality of display pixels are stopped until a new digital image signal is written to the same display pixels.

8. A display apparatus of claim 1, wherein, said display apparatus is a liquid crystal display apparatus; and said display element includes a liquid crystal capacitor and a pair of electrodes for driving said liquid crystal capacitor.

9. A display apparatus of claim 8, wherein, said pair of electrodes for driving said liquid crystal capacitor comprises an individual display electrode for each display pixel and a counter electrode provided to face said display electrode; and at least one of the signals selected by said signal selector is an alternating current voltage signal which oscillates around the voltage of said counter electrode.

10. A display apparatus, comprising:

a plurality of gate lines provided in one direction of a substrate;

a plurality of drain lines provided in a direction intersecting with said gate lines; and a plurality of display pixels, each of which is selected by a scan signal supplied from corresponding one of said plurality of gate lines, and which is supplied with an image signal from corresponding one of said plurality of drain lines; wherein each of said plurality of display pixels comprises:

a display element;

a first display circuit having a storing circuit, for storing a digital image signal from said corresponding one of said plurality of drain lines in response to a scan signal from said corresponding one of said plurality of gate lines; and a second display circuit having a storage capacitor for storing an analog image signal from said corresponding one of said plurality of drain lines in response to a scan signal from said corresponding one of said plurality of gate lines;

and further including an output selector which selectively supplies data stored in one of said first display circuit and said second display circuit to said display element.

11. A display apparatus of claim 1, wherein said display pixel further comprises a display circuit selector for selectively supplying an image signal from said corresponding one of drain lines to said first or second display circuit, said display circuit selector is switched in response to a switching signal, and said switching signal is a signal common to a plurality of pixels.

12. A display apparatus comprising a plurality of display pixels, wherein each of said display pixels comprises:

a pixel electrode;

a first storing circuit for storing digital data and outputting signals to said pixel electrode;

a second storing circuit for storing analog data and outputting signals to said pixel electrode; and a storing circuit selector for switching between said first and second storing circuits;

and further including an output selector which selectively supplies data stored in one of said first display circuit and said second display circuit to said display element.

13. A display apparatus of claim 12, wherein said first storing circuit comprises a predetermined number of storing elements, said number corresponding to the number of bits in said digital image signal; and further including a signal selector for selecting a signal to be supplied to said display element from among a predetermined number of signals, said number corresponding to the number of bits in said digital image signal.

14. A display apparatus of claim 12, wherein, said first storing circuit stores said digital image signal using one or more inverters.

15. A display apparatus of claim 12 wherein, said plurality of display pixels is capable of displaying a still image.

16. A display apparatus of claim 12, wherein, after a still image is written to each of said plurality of display pixels as a digital image signal, operations of driving circuits for driving said plurality of display pixels are stopped until a new digital image signal is written to the same display pixels.

17. A display apparatus of claim 12, wherein, said display apparatus is a liquid crystal display apparatus; and said display element includes a liquid crystal capacitor and a pair of electrodes for driving said liquid crystal capacitor.

18. A display apparatus according to claim 1, wherein, said output selector selectively supplies an output from said first display circuit or an output from said second display circuit to said display element according to a control signal which is common with a control signal of said display circuit selector.

19. A display apparatus according to claim 1, wherein, said output selector is connected between said first display circuit and said second display circuit and said display element.

20. A display apparatus according to claim 1, wherein, said analog image signal stored in said second display circuit is supplied to said display element through said output selector when said analog image signal is selected by said output selector.

21. A display apparatus according to claim 10, wherein, said output selector is connected between said first display circuit and said second display circuit and said display element.

22. A display apparatus according to claim 10, wherein, said analog image signal stored in said second display circuit is supplied to said display element through said output selector when said analog image signal is selected by said output selector.

23. A display apparatus according to claim 12, wherein, said output selector is connected between said first display circuit and said second display circuit and said display element.

24. A display apparatus according to claim 12, wherein, said analog image signal stored in said second display circuit is supplied to said display element through said output selector when said analog image signal is selected by said output selector.

* * * * *